US007751583B2

(12) United States Patent
Akino

(10) Patent No.: US 7,751,583 B2
(45) Date of Patent: Jul. 6, 2010

(54) SHIELDING HOUSING FOR A CONDENSER MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1170 days.

(21) Appl. No.: 11/248,326

(22) Filed: Oct. 13, 2005

(65) Prior Publication Data

US 2006/0093166 A1 May 4, 2006

(30) Foreign Application Priority Data

Oct. 20, 2004 (JP) ..... 2004-305561

(51) Int. Cl.
*H04R 9/08* (2006.01)
*H04R 25/00* (2006.01)

(52) U.S. Cl. ..... 381/355; 381/189

(58) Field of Classification Search ..... 381/355
See application file for complete search history.

(56) References Cited

U.S. PATENT DOCUMENTS 4,413,527 A * 11/1983 Sugiura et al. ..... 73/754
4,757,546 A * 7/1988 Akino ..... 381/357
6,188,773 B1 2/2001 Murata et al.
6,683,245 B1 * 1/2004 Ogawa et al. ..... 174/382
6,827,834 B2 * 12/2004 Stewart et al. ..... 205/184

FOREIGN PATENT DOCUMENTS

JP S61-140695 U 8/1986
JP S61-174288 U 10/1986
JP H02-133089 U 11/1990
JP H11-175191 A 7/1999

* cited by examiner

*Primary Examiner*—Brian Ensey
*Assistant Examiner*—Sunita Joshi
(74) *Attorney, Agent, or Firm*—Manaub Kanesaka

(57) ABSTRACT

In a condenser microphone having a microphone case formed by a casting, the resistivity of the surface of the microphone case is decreased surely, and the shielding function of the microphone case is made stable. In a condenser microphone in which a substrate including an audio output circuit connected to a condenser microphone unit is housed therein, and a cylindrical microphone case 10 mounted with an output connector is provided on one end side, the microphone case 10 being formed by casting, a conductive layer 10*b* having a lower resistivity than that of a raw material of the microphone case 10 is formed integrally on a casting surface 10*a* on the outer surface side of the microphone case 10.

3 Claims, 1 Drawing Sheet

SHIELDING HOUSING FOR A CONDENSER MICROPHONE

CROSS REFERENCE TO RELATED APPLICATION

The present application is based on, and claims priority from, Japanese Application Number JP2004-305561, filed Oct. 20, 2004, the disclosure of which is hereby incorporated by reference herein in its entirety.

TECHNICAL FIELD

The present invention relates to a shielding housing for a condenser microphone and, more particularly, to a microphone case thereof.

BACKGROUND ART

A condenser microphone includes a microphone unit in which a diaphragm and a backplate are arranged so as to be opposed to each other. The microphone unit incorporates an impedance converter because of its very high impedance. As the impedance converter, a field effect transistor (FET) is usually used, and on rare occasions, a vacuum tube is used.

An electronic circuit for audio output of the condenser microphone is housed in a metallic microphone case in a state of being mounted on a substrate. Usually, at one end of the microphone case, a three-pin type output connector specified in EIAJ RC5236 (Audio latch lock round type connector) is mounted. The output connector is connected to a phantom power source via an output cable (balanced shielded cable).

If strong electromagnetic waves radiated from a cellular phone or the like are applied to the microphone or the output cable, the electromagnetic waves pass through the output cable and intrude into the microphone via the output connector. In the microphone, the electromagnetic waves are sometimes demodulated by the impedance converter and delivered from the microphone as noise having an audio frequency.

To prevent this phenomenon, No. 1 pin for grounding of the three pins that the output connector has is connected to the microphone case, and an outer ring of a male plug on the output cable side, which connects with a shield coating, is brought into contact with the inner surface of the microphone case to provide electrical connection, by which a shielding function is given to the microphone case.

A high frequency current flowing in the microphone case due to the electromagnetic waves flows on the surface only due to the skin effect. Usually, the microphone case is manufactured by casting (die casting) of zinc, aluminum, etc. from the viewpoint of workability of microphone case and cost constraints, and the resistivity of casting surface is increased by an oxide film as compared with the base material, so that a sufficient shielding effect cannot be achieved.

The resistivity of the surface can be decreased to some extent by removing the oxide film on the casting surface by cutting. However, usually, since a casting has blowholes therein due to a gas at the time of casting operation, even if the surface is cut, there is no guarantee that the resistivity of the surface necessarily decrease. Also, in the case where painting is performed, the resistivity of the surface is increased by the surface treatment (chromate treatment etc.).

SUMMARY OF THE INVENTION

Accordingly, an object of the present invention is to provide a condenser microphone having a microphone case formed by a casting, the microphone case having a surely decreased surface resistivity and hence having a stable shielding function.

To achieve the above object, the present invention provides a condenser microphone in which a substrate including an audio output circuit connected to a condenser microphone unit is housed therein, and a cylindrical microphone case mounted with an output connector is provided on one end side, the microphone case being formed by casting, wherein a conductive layer having a lower resistivity than that of a raw material of the microphone case is formed integrally on a casting surface on the outer surface side of the microphone case.

In the case where the microphone case is formed by a casing of zinc or aluminum, the conductive layer is preferably formed of silver or copper, which has a lower resistivity than that of the microphone case. Also, as a preferable forming method for the conductive layer, a plating technique or an ion plating technique can be cited.

According to the above-described configuration, since the conductive layer having a low resistivity is formed integrally on the casting surface on the outer surface side of the microphone case, a high frequency current due to electromagnetic waves flows easily on the outer surface of the microphone case due to the skin effect. As a result, the shielding function of the microphone case becomes stable, and noise can be effectively prevented from being generated by the intrusion of electromagnetic waves into the microphone. Also, the surface strength of the microphone case can be increased.

DETAILED DESCRIPTION

Figure 1:
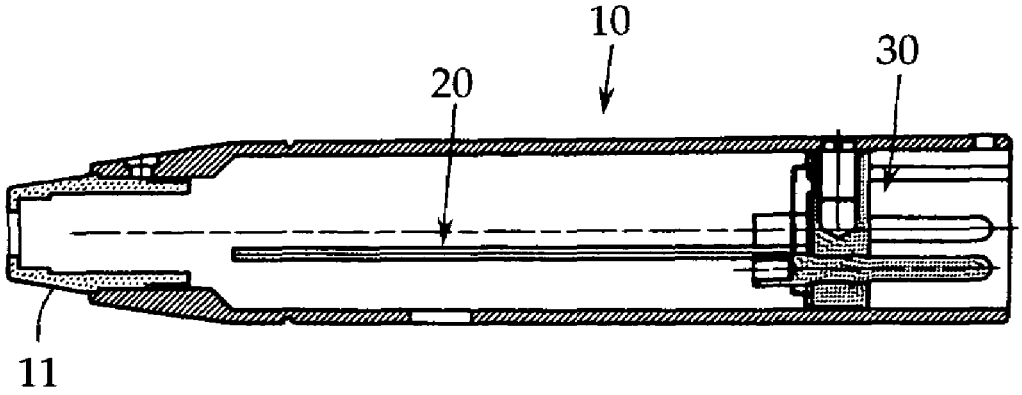
FIG. 1 is a sectional view showing one example of a microphone case that a condenser microphone in accordance with the present invention has.
Figure 2:
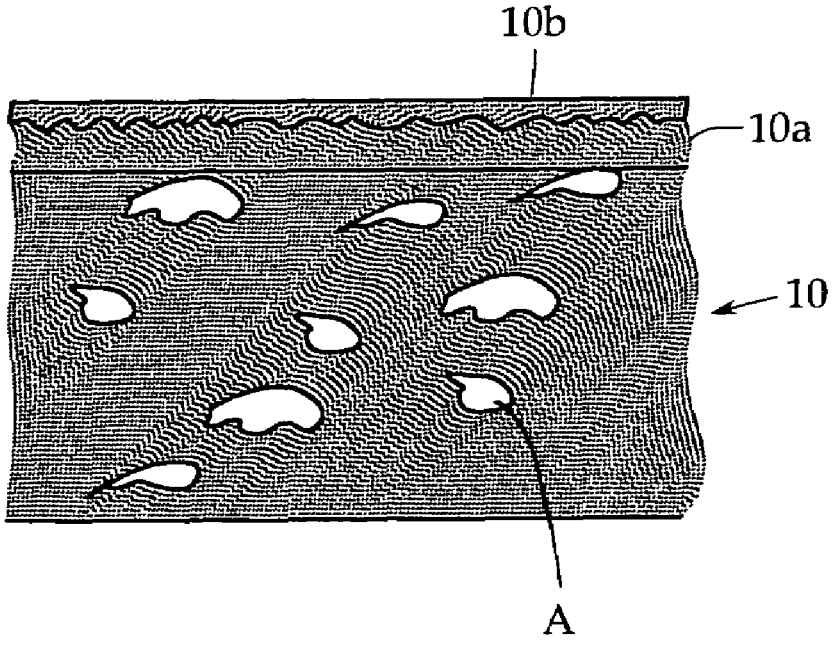
FIG. 2 is a partially enlarged sectional view of the microphone case shown in FIG. 1.

An embodiment of the present invention will now be described with reference to FIGS. 1 and 2. The present invention is not limited to this embodiment. FIG. 1 is a sectional view showing one example of a microphone case that a condenser microphone in accordance with the present invention has, and FIG. 2 is a partially enlarged sectional view of the microphone case shown in FIG. 1.

A microphone case 10 shown in FIG. 1 is, as in the case of a gooseneck microphone or a tie clip microphone, a microphone case used for an audio output module section of a separate condenser microphone in which a condenser microphone unit and the audio output module section are connected to each other via a microphone cable.

The illustration of the condenser microphone unit is omitted because the condenser microphone unit may be a publicly known one. Also, the audio output module section is also called a power module section because it is provided with a polarization power supply circuit for the condenser microphone unit.

The microphone case 10 consists of a cylindrical body formed by casting (die casting) of zinc, aluminum, or the like from the viewpoint of workability and cost constraints, and a substrate 20 mounted with an audio output circuit, the polarization power supply circuit, and the like is housed in the microphone case 10.

To the substrate 20, a microphone cable, not shown, led into the microphone case 10 is soldered, and to one end side of the microphone case 10, a cord bush 11 for the microphone cable is attached.

The other end side of the microphone case 10 forms a connector housing section, and therein is mounted an output connector 30. As the output connector 30, a three-pin type output connector specified in EIAJ RC5236 (Audio latch lock round type connector) is used.

The output connector 30 includes three pins of No. 1 pin for grounding, No. 2 pin on the signal hot side, and No 3 pin on the signal cold side. Since FIG. 1 is a sectional view, only two pins of the three pins are shown. A pin shown in section is the No. 1 pin for grounding, and the No. 1 pin is allowed to conduct to the microphone case 10 via a metal conductor plate, not shown.

When this condenser microphone is used, the output connector 30 is connected to a phantom power source via an output cable consisting of a balanced shielded cable (neither the phantom power source nor the output cable are shown). The output cable is provided with a male plug that is detachable from the output connector 30.

Although not shown, the male plug is provided with an outer ring connected to a shield coating of the balanced shielded cable, so that when the male plug is inserted in the connector housing section of the microphone case 10, the outer ring comes into contact with the inner surface of the microphone case 10, thereby causing electrical conduction.

Thus, the microphone case 10 is connected to the No. 1 pin for grounding of the output connector 30, and also is connected to the shield coating of the balanced shielded cable via the outer ring, so that a shielding function is provided. However, the casing surface of the microphone case 10 is formed with an oxide film exhibiting high resistance, so that a high frequency current due to electromagnetic waves is less prone to flow, and the staying high frequency current is liable to intrude into the microphone case 10.

To avoid this phenomenon, in the present invention, as shown enlargedly in FIG. 2, a conductive layer 10*b* with a lower resistivity than that of a raw material used for casting (in this example, zinc or aluminum) is integrally formed on a casting surface 10*a* on the outer surface of the microphone case 10. In FIG. 2, void-shaped blowholes A that are produced during casting are shown in an exaggerated way.

The conductive layer 10*b* is preferably formed of silver (Ag) or copper (Cu), which is available easily at a low cost. For example, in the case where the microphone case 10 is formed by a casting of zinc (Zn), the resistivity of zinc is 0.0000000550 Ωm, and by forming the oxide film, the resistivity of the casting surface 10*a* is further increased.

By contrast, the resistivity of silver is 0.0000000159 Ωm, and the resistivity of copper is 0.0000000167 Ωm. Therefore, by applying these metal materials to the conductive layer 10*b*, the resistivity on the surface of the microphone case 10 is decreased, and hence the high frequency current due to electromagnetic waves flows to the grounding side in a moment, which prevents the high frequency current from intruding into the microphone case 10.

In order to form the conductive layer 10*b* on the casting surface 10*a*, a plating technique or an ion plating technique is preferably used. The use of these techniques can increase the surface strength of the microphone case 10 and also can provide a sense of high quality in terms of appearance as other effects.

The present invention has been explained above by taking a microphone case of output module section for a separate condenser microphone as an example. However, the present invention can be applied to all of microphone cases housing an electronic circuit for a condenser microphone, and as one example, can be applied to a microphone case used as a microphone grip for a hand-held integral microphone.

The invention claimed is:

1. A condenser microphone comprising:

a substrate including an audio output circuit to be connected to a condenser microphone unit, a cylindrical microphone case retaining the substrate therein, said microphone case being made of casting metal, an output connector provided on one end of the microphone case and connected to the audio output circuit, and a conductive layer formed integrally on an outer surface of the casting metal of the microphone case, said conductive layer having a lower resistivity than that of the casting metal of the microphone case so that a high frequency current due to electromagnetic waves flows through the conductive layer on the outer surface of the microphone case due to a skin effect, wherein the microphone case is formed of a casting zinc or aluminum, and the conductive layer is formed of silver or copper.

2. A condenser microphone comprising:

a substrate including an audio output circuit to be connected to a condenser microphone unit, a cylindrical microphone case retaining the substrate therein, said microphone case being made of casting metal, an output connector provided on one end of the microphone case and connected to the audio output circuit, and a conductive layer formed integrally on an outer surface of the casting metal of the microphone case, said conductive layer having a lower resistivity than that of the casting metal of the microphone case so that a high frequency current due to electromagnetic waves flows through the conductive layer on the outer surface of the microphone case due to a skin effect, wherein the conductive layer is a plating metal or an ion plating metal.

3. A condenser microphone comprising:

a substrate including an audio output circuit to be connected to a condenser microphone unit, a cylindrical microphone case retaining the substrate therein, said microphone case being made of casting metal, an output connector provided on one end of the microphone case and connected to the audio output circuit, and a conductive layer formed integrally on an outer surface of the casting metal of the microphone case, said conductive layer having a lower resistivity than that of the casting metal of the microphone case so that a high frequency current due to electromagnetic waves flows through the conductive layer on the outer surface of the microphone case due to a skin effect, wherein the output connector includes a grounding pin, which is electrically connected to the microphone case and the conductive layer thereon.

* * * * *